US005369218A

United States Patent [19]

Konishi

[11] Patent Number: 5,369,218

[45] Date of Patent: Nov. 29, 1994

[54] EXTERNAL DEVICE PHRASE DATA INPUT/OUTPUT APPARATUS FOR AN ELECTRONIC MUSICAL INSTRUMENT

[75] Inventor: Shinya Konishi, Shizuoka, Japan

[73] Assignee: Kabushiki Kaisha Kawai Gakki Seisakusho, Japan

[21] Appl. No.: 958,517

[22] Filed: Oct. 8, 1992

[30] Foreign Application Priority Data

Oct. 14, 1991 [JP] Japan ..... 3-291974

[51] Int. Cl.[5] ..... G10H 1/00

[52] U.S. Cl. ..... 84/649

[58] Field of Search ..... 84/609-620, 84/634-638, 649-658, 666-669

[56] References Cited

U.S. PATENT DOCUMENTS

| | | | |
|---|---|---|---|
| 4,982,643 | 1/1991 | Minamitaka | 84/613 |
| 5,099,740 | 3/1992 | Minamitaka | 84/651 |
| 5,189,238 | 2/1993 | Hayakawa | 84/609 |

*Primary Examiner*—Stanley J. Witkowski

*Attorney, Agent, or Firm*—Andrus, Sceales, Starke & Sawall

[57] ABSTRACT

A phrase data input/output apparatus for an electronic musical instrument having an external device coupled thereto. The apparatus, upon receipt of key data from a keyboard, selects either a tone generator for generating a single musical tone in agreement with the key data or a phrase playing circuit for generating a specified phrase of multiple musical tones in agreement with the key data. The apparatus includes an instructing circuit for instructing either normal playing or phrase playing of the instrument. An assigning circuit assigns the key data from the keyboard to either the tone generator or to the phrase playing circuit of the instrument, upon receipt of an instruction from said instructing circuit. An output circuit, responsive to said assigning circuit sends to the external device either key data, outputted by the tone generator, or phrase playing control data obtained through a predetermined conversion of said key data from said keyboard and outputted by the phrase playing circuit.

6 Claims, 8 Drawing Sheets

EXTERNAL DEVICE PHRASE DATA INPUT/OUTPUT APPARATUS FOR AN ELECTRONIC MUSICAL INSTRUMENT

BACKGROUND OF THE INVENTION

1. Field of the Invention

The present invention relates to a phrase data input-/output apparatus, an apparatus that is employed, for example, as an electronic musical instrument and that exchanges phrase data, which is used for phrase playing, with an external device.

2. Description of the Related Art

Recently, various electronic musical instruments that perform phrase playing have been developed and practically employed. Areas of the keyboards of such electronic musical instruments are allocated for the entry of motif data (phrase data).

Further, another type of electronic musical instrument is known that transmits player-entered key data to an externally connected electronic musical instrument, and thus insures that identical key data is used by both musical instruments.

Such a multiple-element electronic musical instrument system is so designed that key data used for phrase playing by one electronic musical instrument is sent, unchanged, to another externally connected musical instrument. With such an arrangement, the musical performance of the electronic musical instrument that receives the transmitted data is impaired.

Also known is an automatic playing apparatus that sends prestored automatic play data and phrase data to an external electronic musical instrument, etc. Since with this apparatus key data must be sent for each performance, as the volume of play data increases, so too does the load placed on the output processing system.

SUMMARY OF THE INVENTION

To overcome these shortcomings, it is the object of the present invention to provide a phrase data input-/output apparatus that transmits to an external device data for instructing phrase playing, but does not transmit to that device key data which is used for phrase playing; and that can reduce the output processing load.

A phrase data input/output apparatus according to the present invention, an apparatus that is employed as an electronic musical instrument and that, upon receipt of key data from a keyboard, selects either tone generating means, for generating a single musical tone in agreement with the key data, or phrase playing means, for generating a specified phrase of multiple musical tones in agreement with the key data, thereby to produce music, comprises: instructing means for instructing either normal playing or phrase playing; first assigning means for, upon receipt of an instruction from the instructing means, assigning the key data from the keyboard either to the tone generating means or to the phrase playing means; and output means for, in agreement with instruction data from the assigning means, sending to an external device either key data, output by the tone generating means, or phrase playing control data, obtained through a predetermined conversion of the key data from the keyboard and output by the phrase playing means.

According to the present invention, when normal playing is instructed by the instructing means, the phrase data input/output apparatus assigns key data from a keyboard to the tone generating means to produce musical tones, and sends the key data to an external device by the output means. When phrase playing is instructed by the instructing means, the apparatus transmits key data from the keyboard to the phrase playing means to start phrase playing, and converts the key data into phrase playing control data, for selecting a phrase pattern or for instructing the start of phrase playing, and sends that converted data to an external device by the output means.

As key data used for phrase playing is not outputted unchanged when phrase playing is performed, the production of noise that has no musical characteristics is avoided; and since phrase playing control data for instructing phrase playing is outputted rather than key data, phrase playing by multiple electronic musical instruments is possible.

When phrase playing is performed using multiple electronic musical instruments, as the apparatus outputs only phrase playing control data, both the output processing load placed on the data transmitting apparatus and the input processing load placed on the data receiving apparatus are reduced, and there is almost no tone production time lag.

DETAILED DESCRIPTION OF THE PREFERRED EMBODIMENTS

Figure 1:
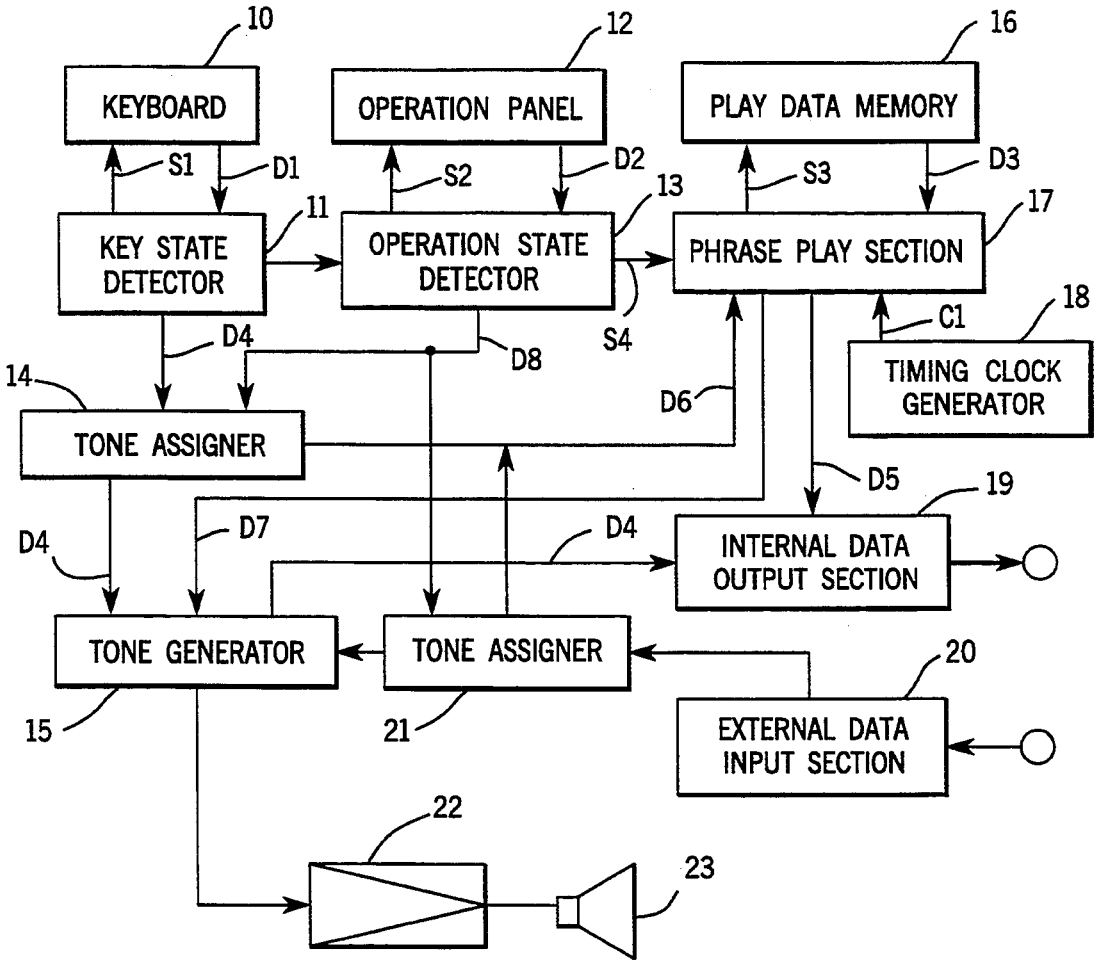
FIG. 1 is a schematic block diagram illustrating the general arrangement of the first embodiment of a phrase data input/output apparatus according to the present invention.

The schematic block diagram in FIG. 1 shows the general structure of the first embodiment of a phrase data input/output apparatus according to the present invention.

A keyboard 10 has multiple keys, and key switches that open and close upon key depression/release. The keyboard 10 is used to designate phrase data for phrase playing and to play melodies.

The keyboard 10 has two specific areas: a lower area (hereafter referred to as "phrase playing area"), which is used for phrase playing, and an upper area (hereafter referred to as "melody playing area"), which is used for melody playing.

During playing, the keyboard 10, upon receipt of a key scan signal S1 from a key state detector 11, scans the key switches and produces key scan data D1, which indicates the depression/release state of a key. The key scan data D1 is then sent to the key state detector 11.

The key state detector 11, which to detect key depression at the keyboard 10 sends the key scan signal S1 to the keyboard 10 and in turn receives the key scan data D1 from the keyboard 10, uses the received key scan data D1 to produce key data D4. This key data D4 is supplied to a tone assigner 14.

An operation panel 12 has various switches for controlling the phrase data input/output apparatus, a display, etc. The switches include a phrase mode switch, the main feature of the present invention, as well as the general switches provided for an electronic musical instrument, e.g., a timbre select switch, a rhythm select switch, and a volume switch (none of them shown).

The phrase mode switch of the operation panel 12 is used to shift the mode of the apparatus to a phrase play mode. When this switch has been used to set the mode of the apparatus to the phrase play mode, the keys in the phrase playing area of the keyboard 10 are used to perform phrase playing.

An operation state detector 13 sends a panel scan signal S2 to the operation panel 12. In response to the panel scan signal S2, the operation panel 12 outputs panel scan data D2 that indicates the settings of the switches. The panel scan data D2 is transmitted to the operation state detector 13.

The operation state detector 13, which to detect the settings of the switches on the operation panel 12 sends the panel scan signal S2 to the operation panel 12, and in turn receives the panel scan data D2 from the operation panel 12, uses the received panel scan data D2 to produce phrase play mode data D8. This phrase play mode data D8 is supplied to tone assigners 14 and 21.

A change of play mode, which is determined by the setting of the phrase mode switch, is sent as a phrase mode signal S4 to a phrase play section 17.

The tone assigner 14, upon receipt of the key data D4 from the key state detector 11, and in consonance with the phrase play mode data D8 from the operation state detector 13, either sends the key data D4 to a tone generator 15 or sends a read address D6 to the phrase play section 17.

Thus, when the phrase play mode data D8 indicates that phrase playing is not to be performed, the tone assigner 14 sends the key data D4 to the tone generator 15; but when the phrase play mode data D8 indicates that phrase playing is to be performed, the tone assigner 14 produces a read address D6, for the phrase play data that correspond to the key data D4, and supplies the read address D6 to the phrase play section 17.

The tone generator 15, after it receives key data either from the tone assigner 14 or the tone assigner 21, which will be described later, or after it receives tone data D7 from the phrase play section 17, reads tone wave data and envelope data from a wave memory (not shown), adds an envelope to the read-out tone wave data and outputs the resultant data as a tone signal. This tone signal is sent to an amplifier 22.

In normal play mode, the tone generator 15 also sends the key data D4, which it receives from the tone assigner 14, to an internal data output section 19, and a musical tone that corresponds to a depressed key is produced both by the phrase data input/output apparatus and by an externally connected electronic musical instrument.

The amplifier 22 amplifies a tone signal from the tone generator 15 by a predetermined gain, and then supplies the resultant signal to a loudspeaker 23. The loudspeaker 23 is a well known one that converts an electric signal into an acoustic signal.

A play data memory 16 is a storage area for automatic play data that is used for phrase performance. The play data memory 16 consists of, for example, a ROM (Read Only Memory).

One unit of play data is composed of key data (key number) KEY or measure data or an END mark, and step time STEP, gate time GATE and velocity VELO. A plurality of these units of play data are stored in the play data memory 16.

The key number KEY, which denotes one of the individually numbered keys of a keyboard, designates a pitch. The measure data indicates the end of a measure. The END mark is information indicating the end of the play data.

The step time STEP is information for designating tone-on time in a measure. The gate time GATE designates tone duration. The velocity VELO is information for designating the strength of a musical tone to be produced.

When data is to be read from the play memory 16, the phrase play section 17 transmits a read signal S3 to the play data memory 16. In response to the read signal S3, the play memory 16 produces play data D3 and sends it to the phrase play section 17.

The phrase play section 17 shifts the play mode to phrase play mode when the phrase switch on the operation panel 12 is turned on. When, that is, the operation state detector 13 determines that the phrase switch state is ON and sends a phrase mode signal S4 to the phrase play section 17.

Subsequently, when a key in the phrase playing area of the keyboard 10 is depressed, the phrase play section 17 initiates phrase playing by sending a read signal S3 to the play data memory 16, deriving tone data D7 from play data D3 (read from the play data memory 16 in response to the read signal S3), and transmitting the tone data D7 to the tone generator 15.

In concert with the above-described process, the phrase play section 17 also transmits data D5, which is phrase play control data that specifies a phrase pattern and its start, to the internal data output section 19.

A timing clock generator 18 supplies a read timing clock C1 to the phrase play section 17. In synchronism with the read timing clock C1, the phrase play section 17 reads play data from the play data memory 16.

The internal data output section 19 is an interface circuit. It sends phrase pattern and phrase start data D5, which it receives from the phrase play section 17, to an external device, thereby enabling the phrase data input/output apparatus and an externally connected electronic musical instrument to produce the same musical phrase.

An external data input section 20 is an interface circuit that receives information from an external source. The information that the external data input section 20 receives is sent to the tone assigner 21.

The tone assigner 21, in consonance with phrase play mode data D8 that it receives from the operation state detector 13, sends the information from the external data input section 20 to either the tone generator 15 or the phrase play section 17. The arrangement and the function of the tone assigner 21 are the same as those for the previously described tone assigner 14.

With such an arrangement, the operation of the embodiment according to the present invention will now be described while referring to the flowcharts in FIGS. 2 to 7.

Figure 2:
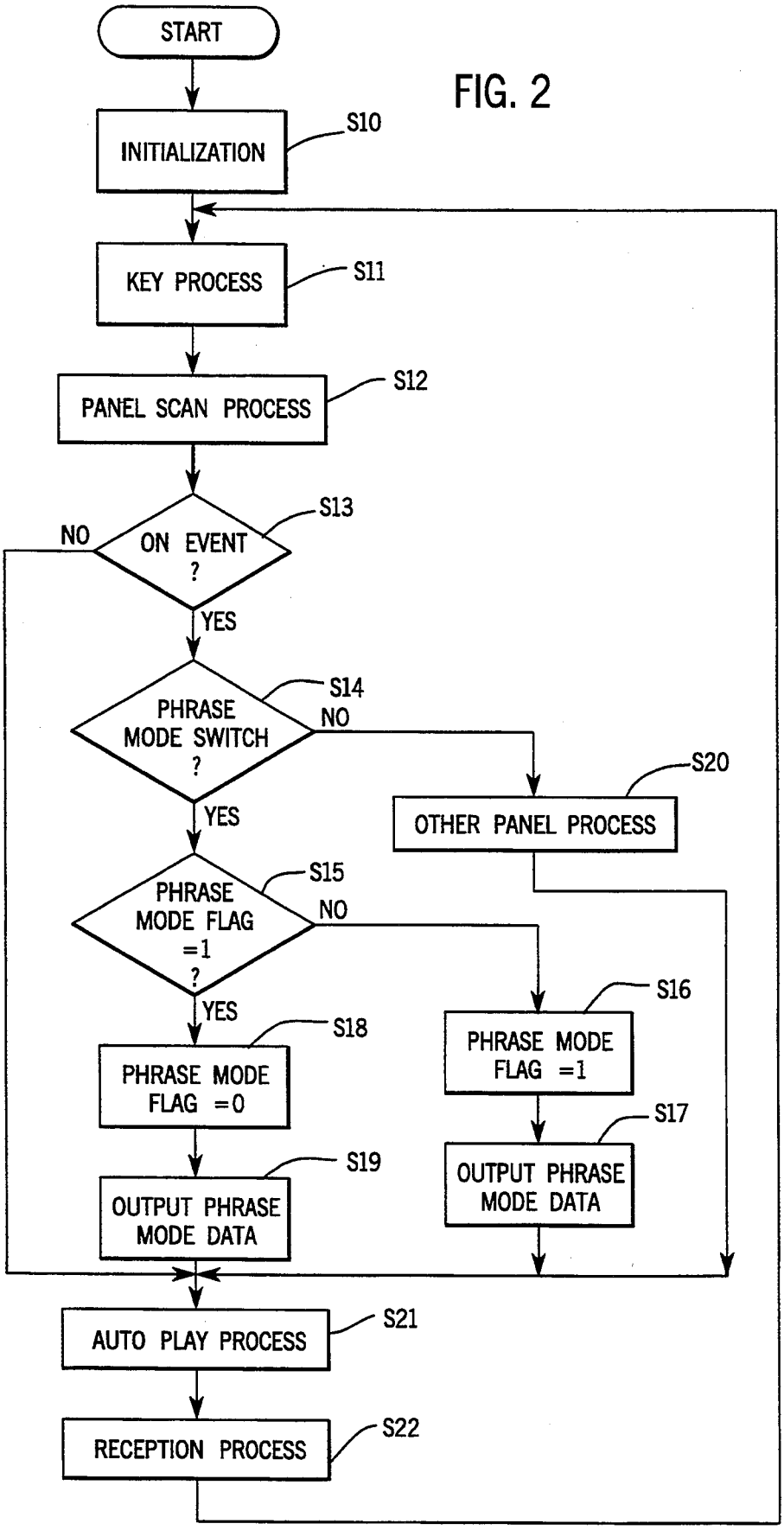
FIG. 2 is a main flowchart for explaining the operation of the first embodiment of the phrase data input-/output apparatus according to the present invention.

When power is switched on, an initialization process is performed as shown in the flowchart in FIG. 2 (step S10). This process establishes the initial internal state of the tone generator 15 and prevents unwanted musical tones from being produced when power is switched on, and clears the contents of a RAM (Random Access Memory) (not shown).

A key process is then performed (step S11). During this process, normal tone generation/release upon key depression/release on the keyboard 10 is performed, and, when phrase play mode is selected, phrase playing is performed upon depression of specified keys. A detailed description of the key process will be given later.

Following this, a panel scan process is performed (step S12). More specifically, the operation state detector 13 fetches the panel scan data D2 from the operation panel 12 and stores it in the RAM (not shown).

A check is then performed to determine whether or not an ON event has occurred at the operation panel 12 (step S13). That is, to determine whether a switch has been newly set ON, the current panel scan data D2, fetched from the operation panel 12, is compared with the previously fetched panel scan data D2 that is held in the RAM.

When it is found that no ON event has occurred, the procedure branches to step S21 and moves to an automatic playing process. When an ON event has occurred, a check is made to determine whether the switch where the ON event occurred is a phrase mode switch (step S14).

If the switch in the ON state is the phrase mode switch, the current setting of a phrase mode flag is checked (step S15). If the setting is not "1", the flag is then set to "1" (step S16).

Phrase mode data is then outputted (step S17). More specifically, to inform an external device of the change in play mode, information that indicates the setting status of the phrase mode flag is sent to that external device via the internal data output section 19. Program control then moves to an automatic play process in step S21. At this point, the keys in the phrase playing area of the keyboard 10 are used for phrase playing.

If, in step S15, the setting of the phrase mode flag is determined to be "1", the phrase mode flag is reset to "0" (step S18) and (as in step S17) phrase mode data is output (step S19). Program control is then shifted to step S21. At this point, all the keys in both the normal playing area and the phrase playing area of the keyboard 10 are used for normal playing.

Through the processes in steps S14 to S16 and S18, the toggle function of the phrase mode switch is accomplished. In this instance, the phrase mode flag is used to indicate whether or not the phrase data input/output apparatus is in phrase play mode. The phrase mode flag is provided in the RAM (not shown).

If it is found in step S14 that no ON event has occurred at the phrase mode switch, processing associated with an ON-event switch is performed (step S20). The processing includes, for example, timbre selection, rhythm selection or volume control. Program control then branches to step S21.

After the automatic playing process in step S21 and a reception process in step S22 are performed, program control returns to step S11, and the above-described processes are repeated.

The automatic playing process in step S21 will now be explained. This process, which is a phrase playing process, is performed mainly by the phrase play section 17.

Figure 3:
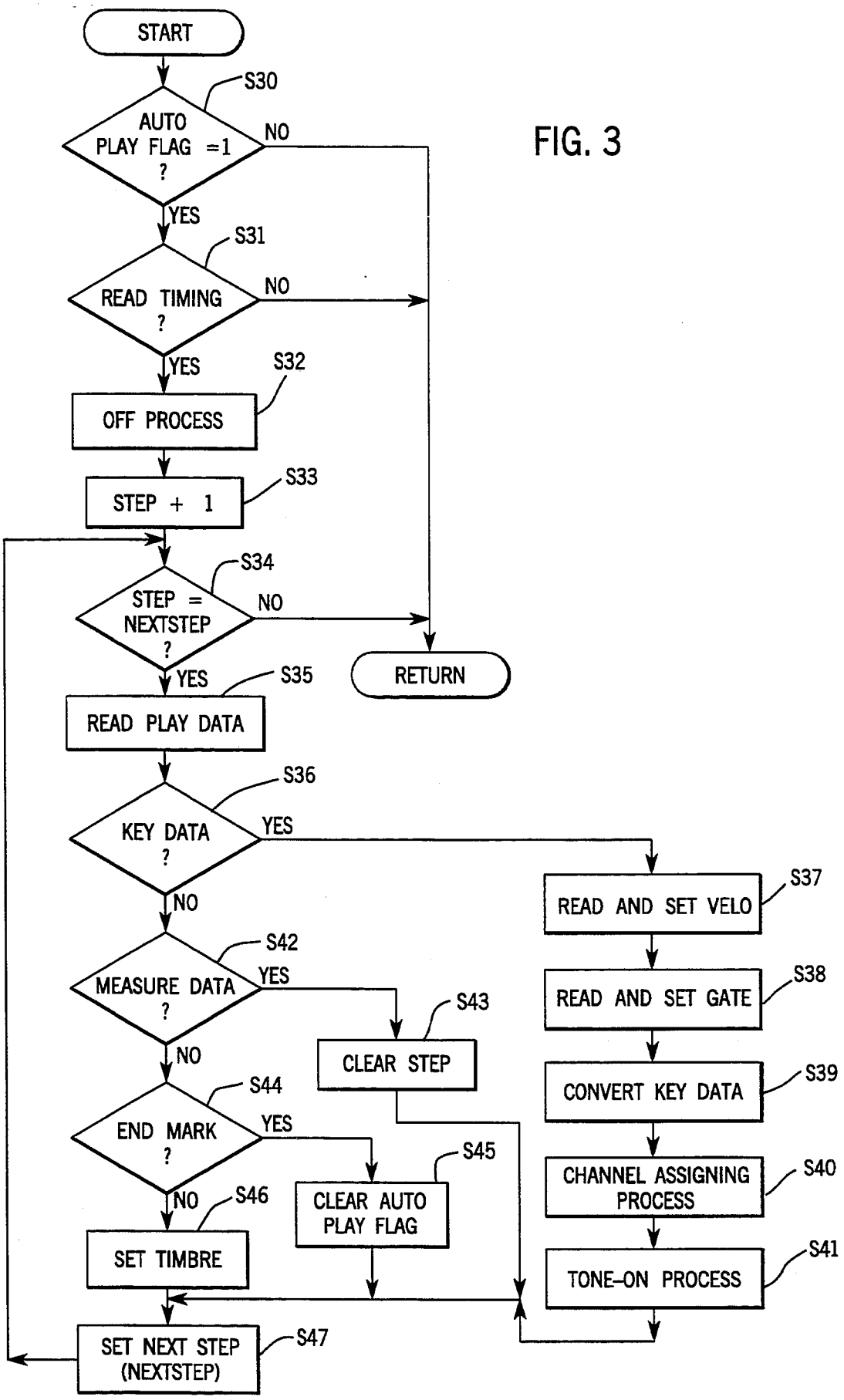
FIG. 3 is a flowchart for explaining an automatic playing process.

FIG. 3 is a flowchart that shows the automatic playing process. During this process, an automatic playing flag is checked to determine whether it is set to "1" (step S30). In phrase play mode, the automatic playing flag is set when keys in the phrase playing area of the keyboard 10 are depressed, and is reset when the keys are released (to be described in detail later).

More specifically, in phrase play mode the automatic playing flag is set as long as keys in the phrase playing area are depressed. The automatic playing process routine is called to start phrase playing.

If, in step S30, the automatic playing flag is not set to "1", program control returns from the automatic playing process routine without performing the following processes, i.e., phrase playing is not performed.

If, in step 30, the automatic playing flag is found to be set to "1", a check is made to determine whether or not it is time to read play data (step S31). More specifically, this process checks for a read timing clock C1, which is output by the timing clock generator 18, to determine whether or not it is time to read play data from the play data memory 16.

When it is not yet time to read play data, the following processes are not performed and program control returns from the automatic playing process routine.

Figure 4:
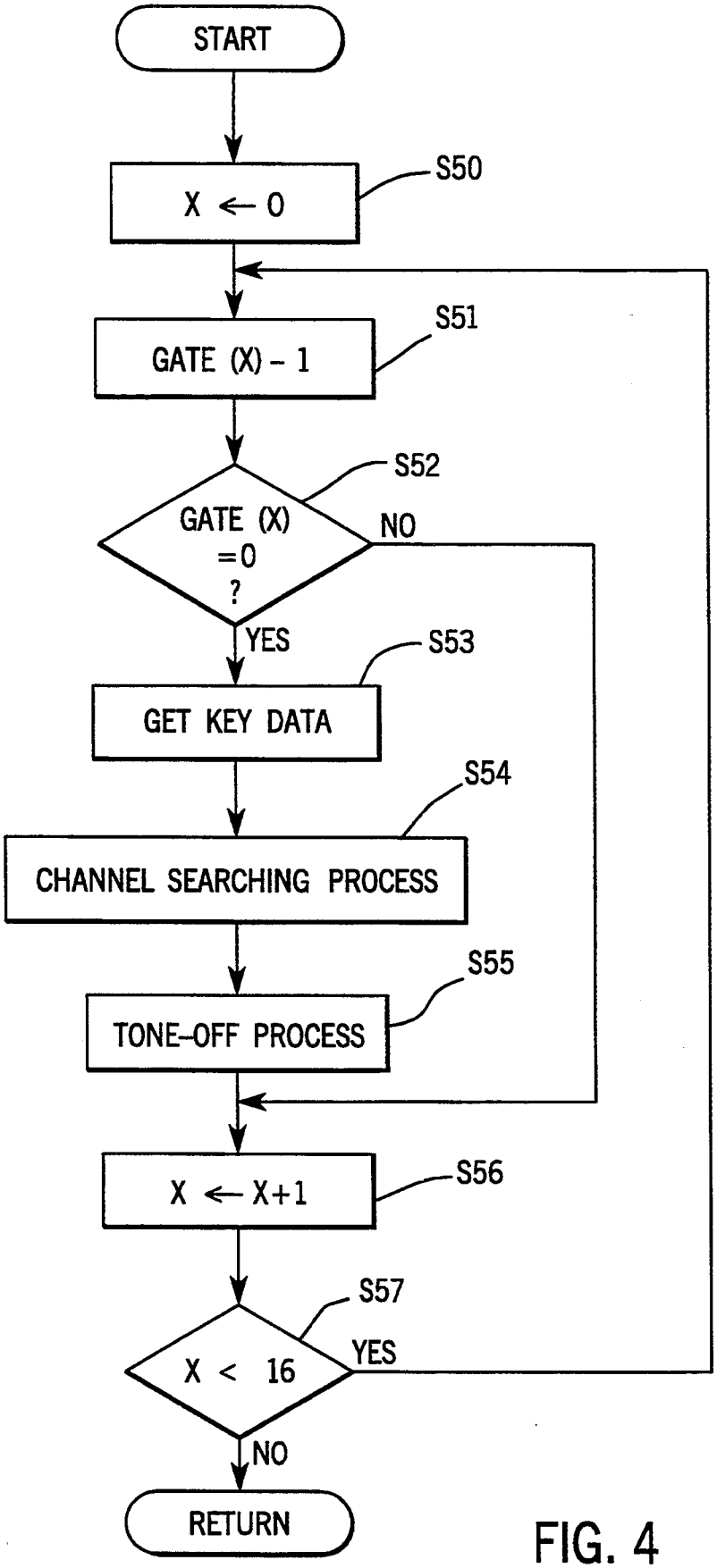
FIG. 4 is a flowchart for explaining an OFF process.

If, in step S31, the process determines that it is time to perform a read, an OFF process is performed (step S32). During this process, a search is made for channels that are in the tone-ON state, i.e., those channels that have a decremented gate time GATE which equals "0", for stopping tone generation. FIG. 4 is a flowchart that shows the OFF process.

The OFF process will now be briefly explained. The phrase data input/output apparatus in this embodiment will have 16 tone-ON channels.

First, a counter, a variable X, is cleared (step S50). The counter serves as a pointer into a 16-entry table wherein in each entry a gate time GATE is stored. The entry that is being processed is designated by the count represented by X.

The gate time GATE (X) in the entry that is designated by the variable X is decremented (step S51), and a check is performed to determine if the resultant value is "0" (step S52). If that value is not "0", execution control branches to step S56, skipping steps S53 to S55.

If the value of the gate time GATE is "0", key data in the entry selected by the variable X is fetched (step S53). This process extracts the tone-ON key data (key number) that is stored in correlation with a gate time GATE in the 16-entry table.

Then, the tone-ON channel is searched to find where a musical tone corresponding to the fetched key data in step S53 is produced (step S54), and tone generation from that channel is stopped (step S55).

Following this, the variable X count is incremented (step S56), and a check is performed to determine if the resultant value is less than "16" (step S57). In other words, the check is performed to determine whether the entries "0" through "15" have been processed.

If the count is less than "16", execution returns to step S51 and the processing is repeated for the next entry. If, through iteration, the count has become "16", or greater, it is assumed that all the entries have been processed, and program control returns from the OFF process routine to step S33 of the automatic playing process routine.

Using the above-described OFF process, tone generation is halted for a key number whose gate time GATE is "0" when read.

When the OFF process is completed, the step time step is incremented, as shown in FIG. 3 (step S33). Step time step is a timing scale for providing tone-ON time. Step time step is incremented at time intervals corresponding to music tempo, and is cleared to "0" at the head of each measure.

When the incremented step time step matches the step time STEP that is included in the play data that is currently being processed, musical tones in accordance with that play data will be generated.

Then, a check is made to decide whether or not the step time step equals the step time STEP of the next play data that is to be processed (hereafter referred to as "next step time NEXTSTEP") (step S34). If the step time step does not equal the next step time NEXTSTEP, program control returns from the automatic playing process routine, indicating that it is not yet time to produce musical tones based on the next play data.

If the step time step equals the next step time NEXTSTEP, play data is read from the play data memory 16 (step S35). The play data read out in this step is key data (key number) KEY, measure data or an END mark.

A check is performed to determine whether or not the read data is key data (step S36). This process is performed by checking a predetermined bit that is included in the first byte of the play data. Checks for the measure data (step S42) and the END mark (step S44) are made in the same manner.

If the read data is found to be key data, velocity VELO in the play data is read out, and the VELO value is set in the tone generator 15 (step S37). Tone volume is thus selected.

Next, gate time GATE in the play data is read out and stored in the 16-entry table described above (step S38). Gate time GATE is used to decide a tone generation stop timing, as described above.

Key data conversion is then performed (step S39). During this process, the play data that is read from the play data memory 16 is converted into tone data having a predetermined format.

Tone-ON channels are assigned through a channel assigning process (step S40), and then tone-ON processing is performed (step S41). Accordingly, musical tones during phrase playing are released via the tone generator 15, the amplifier 22, and the loudspeaker 23. Program control then branches to step S47.

If, in step S36, the read-out play data is not key data, a check is made to determine whether the play data is measure data (step S42). If the play data is found to be measure data, step time step is cleared (step S43), and program control branches to step S47. Phrase playing starts at the head of the next measure.

If, in step S42, the play data is not measure data, a check is performed to determine if that play data is an END mark (step S44). When the play data is found to be an END mark, the automatic playing flag is cleared (step S45), and program control branches to step S47. Phrase playing is then terminated.

When, in step S44, the play data is not an END mark, it is assumed that the play data is timbre select data, and timbre setting processing is performed (step S46). Step time STEP in the next play data that is to be processed is extracted to be used as the next step time NEXTSTEP (step S47). Program execution then returns to step S34 and the processing is repeated.

When the processing of all play data having the same step time STEP is completed, program control returns from the automatic playing process routine.

Figure 5:
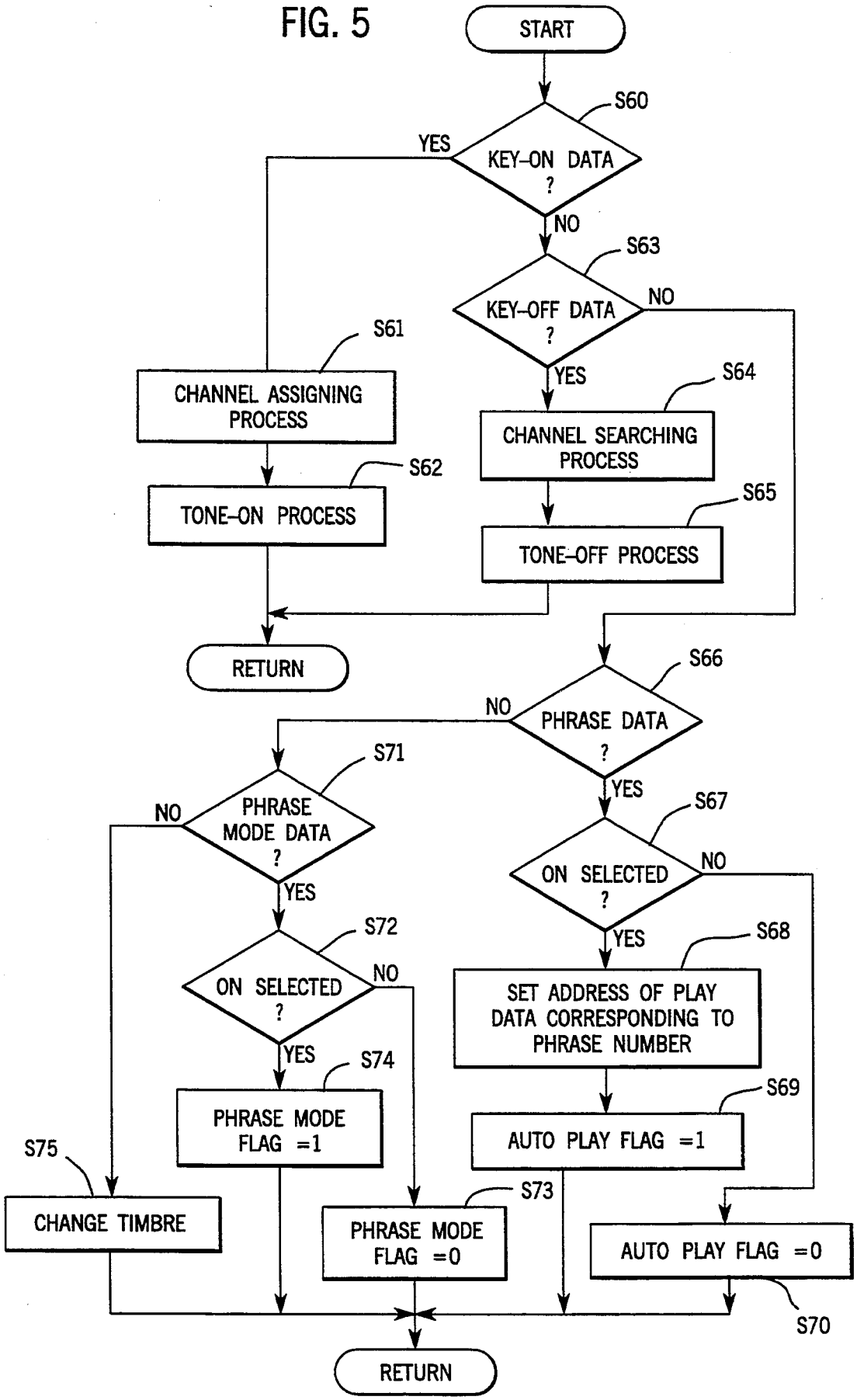
FIG. 5 is a flowchart for explaining a reception process.

A reception process in step S22, shown in FIG. 2, will now be explained. FIG. 5 is a flowchart that shows the reception process. Information that is supplied to the external data input section 20 by an external source constitutes, for example, status data and sequentially supplied associated data.

The status data are used to identify data types. The status data in this embodiment are of four types: key-ON data, key-OFF data, phrase data, and phrase mode data.

If key-ON data or key-OFF data are received as status data, key number data and velocity data are sequentially received as associated data.

If phrase data are received, a phrase number and data for instructing the start/stop of automatic playing are sequentially received as associated data. Phrase numbers are used to identify phrase play data that are stored in the play data memory 16. When phrase mode data are received as status data, information for instructing whether the play mode should be shifted to phrase play mode is sent as associated data.

In the reception process, first, a check is performed to determine whether information supplied by an external source is key-ON data (step S60). If the received data are found to be key-ON data, a channel assigning process (step S61) and a tone-ON process (step S62) are performed. Thus, in consonance with the key data, a normal tone-ON process is accomplished. Program execution then returns from the reception process routine.

If, in step S60, the received data are not key-ON data, a check is made to determine whether those data are key-OFF data (step S63). If the data are found to be key-OFF data, a channel searching process (step S64) and a tone-OFF process (step S65) are performed. Thus, in consonance with the key data, a normal tone-OFF process is accomplished. Program control then returns from the reception process routine.

If, in step S63, the received data are not key-OFF data, a check is made to determine whether or not those data are phrase data (step S66). When the data are found to be phrase data, a check is then performed to determine whether the phrase data reflect an ON state, i.e., whether automatic playing has been selected (step S67).

If the phrase data reflect an ON state, an address which agrees with a phrase number that accompanies the phrase data (an address in the play data memory 16 where automatic play data are stored) is set in the phrase play section 17 (step S68).

An automatic playing flag is then set (step S69), and program control returns from the reception routine. Automatic playing processing is performed in the automatic playing process routine, and phrase playing in consonance with the information supplied by an external source is started.

If, in step S67, the phrase data do not reflect an ON state, an automatic playing flag is reset (step S70). Program control then returns from the reception process routine. The automatic playing process in this routine is skipped, and phrase playing is stopped.

When the data received in step S66 are not phrase data, a check is made to determine whether or not those data are phrase mode data (step S71).

When the data are found to be phrase mode data, a check is performed to determine whether or not the phrase mode data reflect an ON state, i.e., whether phrase play mode has been selected (step S72). If the phrase mode data do not reflect an ON state, a phrase mode flag is reset to "0" (step S73). Program control then returns from the reception process routine. The phrase data input/output apparatus of the present invention is then set in normal play mode.

When the phrase mode data reflect an ON state, the phrase mode flag is set to "1" (step S74). Program execution then returns from the reception routine. The phrase data input/output apparatus is then set in phrase play mode.

The procedures in steps S71 to S74 provide the same state as that obtained when the phrase mode switch on the operation panel 12 is depressed.

If, in step S71, the data in step S66 are not phrase mode data, it is assumed that those data are timbre change data, and a timbre change process is therefore performed (step S75). Program control then returns from the reception process.

Figure 6:
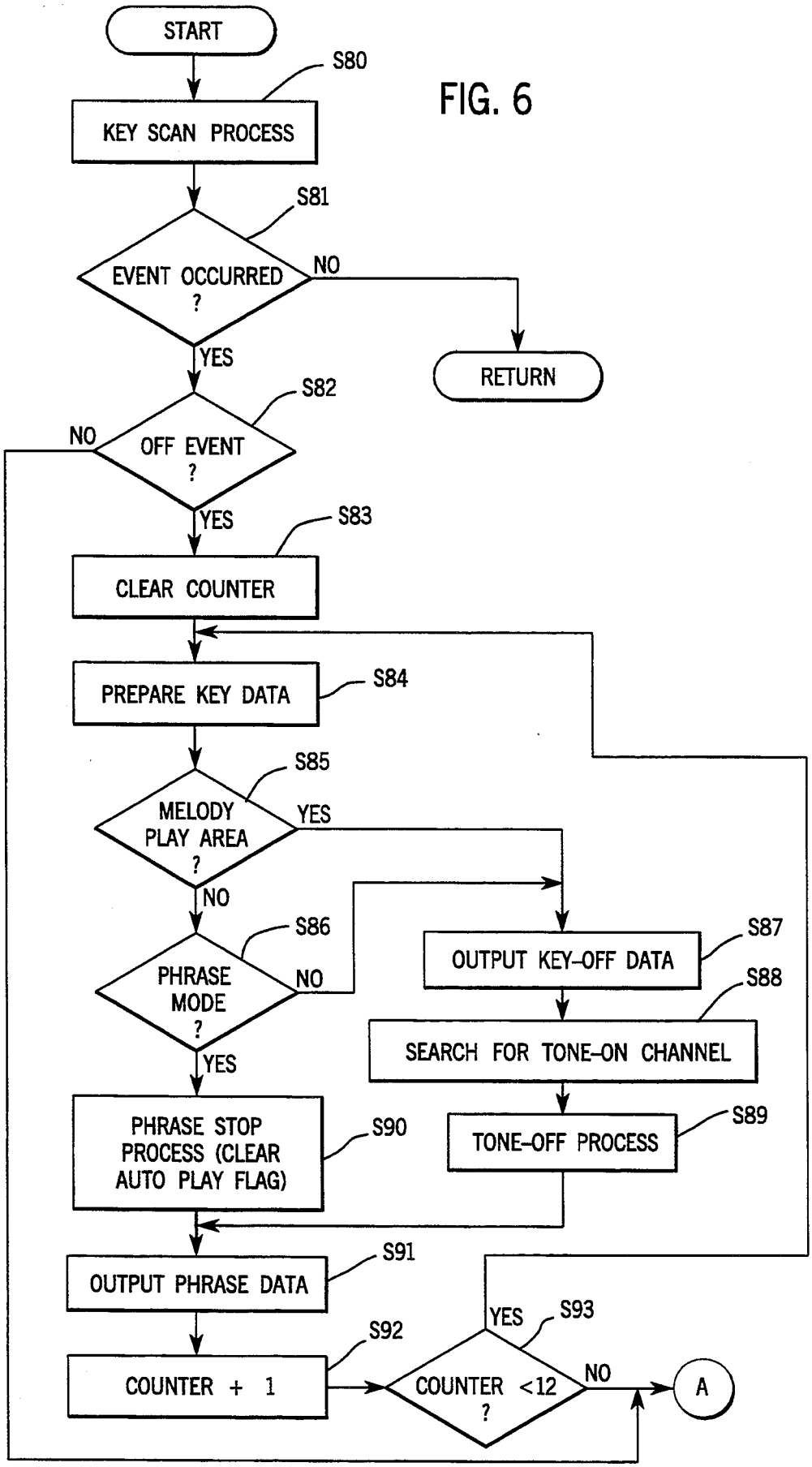
FIGS. 6 and 7 are flowcharts for explaining a key process.
Figure 7:
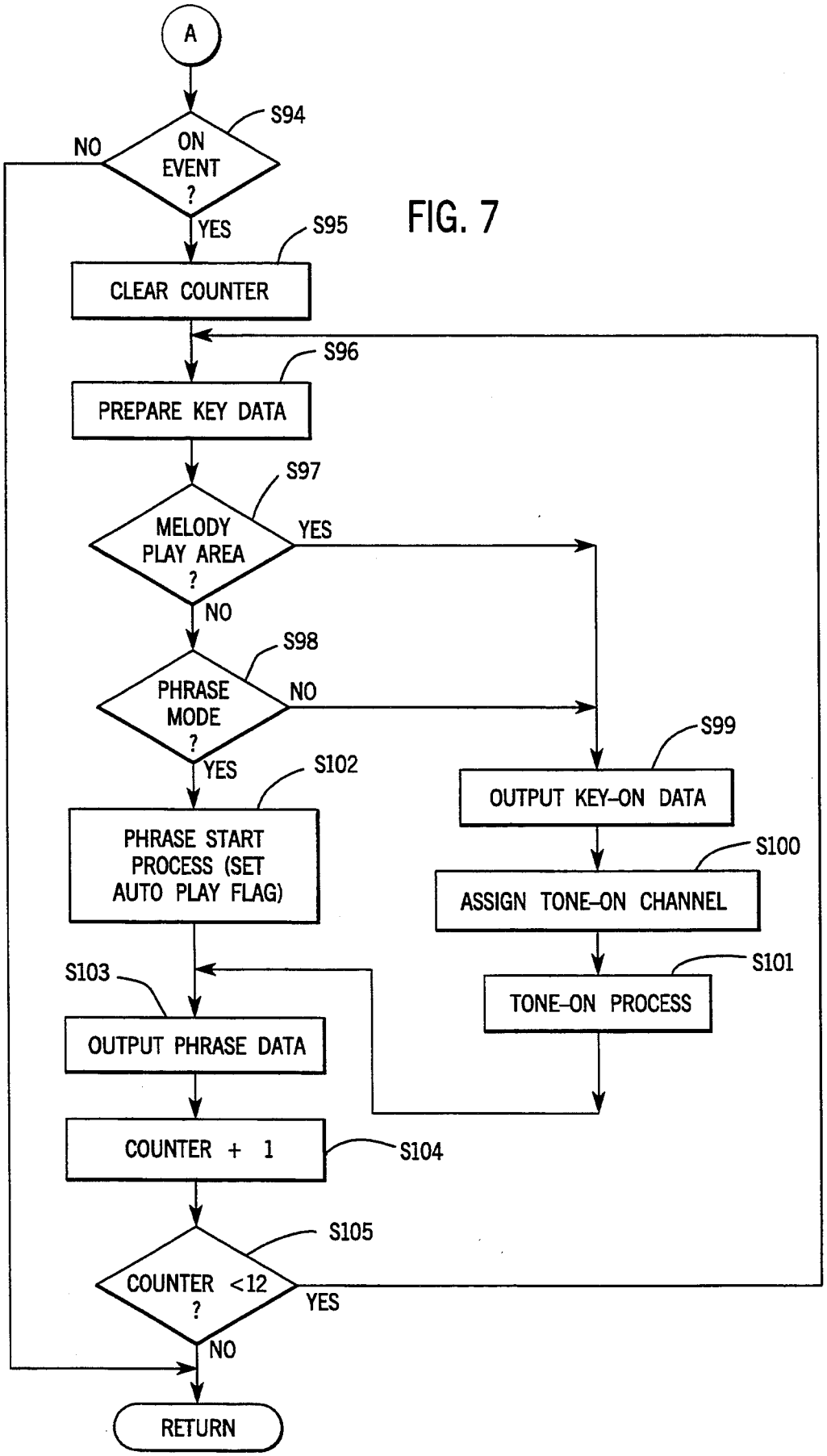

A key process in step S11 of the main routine shown in FIG. 2 will now be explained. FIGS. 6 and 7 are flowcharts that show the key process.

During this process, a key scan procedure is performed (step S80). More specifically, the key state detector 11 fetches key scan data D1 from the keyboard 10 and stores it in the RAM (not shown).

A check is then performed to determine whether or not an event has occurred at the keyboard 10 (step S81). That is, to determine whether there is a changed key (bit), the current key scan data D1, fetched from the keyboard 10, are compared with the previously fetched key scan data D1, which are held in the RAM.

When it is found that no event has occurred, program control returns from the key process routine without performing the subsequent processes. If, however, it is found that an event occurred, a check is performed to determine whether or not it is an OFF event (step S82). When it is found that the event is not an OFF event, the procedure branches to step S94 where an ON event process is performed, as will be described later.

If it is found in step S82 that the event is an OFF event, first, a counter is cleared (step S83). The counter is used to hold an iteration count during the processing of a key area. This iteration count should not exceed "12", since, to simplify the explanation, the following key process description is presented for only one octave (12 keys).

Next, key data are prepared (step S84). During this process, key numbers of the keys in the OFF state are extracted from the key scan data D1 that is output by the key state detector 11.

Then, a check is made to determine whether the detected keys are located in the melody playing area (step S85). When those keys are found to be located in the melody playing area, key-OFF data are output (step S87). That is, not only status data that indicate the key-OFF state, but also key number data and velocity data are sent to an external device via the internal data output section 19.

Following this, tone-ON channels are searched to determine where musical tones that correspond to the relevant keys are produced (step S88), and tone generation is stopped (step S89). Program control then branches to step S91.

If, in step S85, the keys are not located in the melody playing area, it is assumed that those keys are located in the phrase playing area, and a check is made to determine whether the phrase mode is currently set (step S86).

When the phrase mode has not been set, program control branches to step S87, and the sequential steps of the above-described tone-OFF process are performed.

When the phrase mode is selected, a phrase playing stop process is performed (step S90). Through this process, an automatic playing flag is cleared and phrase playing in this routine is stopped.

Then, a process for outputting phrase data is performed (step S91). Through this process an external device is informed that the setting of the automatic playing flag is OFF, i.e., that phase playing should be stopped.

The counter is then incremented (step S92), and a check is made to determine whether the iteration count held by the counter is less than "12", i.e., to determine whether a process for one octave has been completed (step S93). If the iteration count held by the counter is less than "12", the procedure returns to step S84 and the above process is repeated. When the iteration count held by the counter has become "12", or greater, through this process iteration, the process advances to the next step.

Key-ON event processing is performed following step S94.

First, a check is made to determine whether or not an event is an ON event (step S94). If the event is not an ON event, the subsequent processes are not performed and program control returns from the key process routine.

If it is found that the event is an ON event, the counter is cleared in the same manner as for the OFF event processing (step S95), and key data are prepared (step S96).

Then, a check is made to determine whether the detected keys are located in the melody playing area (step S97). When those keys are found to be located in the melody playing area, key-ON data are output (step S99). That is, not only status data that indicate the key-ON state, but also key number data and velocity data are sent to an external device via the internal data output section 19.

Following this, channel assigning is performed (step S100). More specifically, unused tone-ON channels are searched for, or the use of currently-used tone-ON channels is halted, in order to assign to tone-On channels musical tones that correspond to the key data. Then, tone generation is performed (step S101).

If, in step S97, the keys are not located in the melody playing area, it is assumed that those keys are located in the phrase playing area, and a check is made to determine whether the phrase mode is currently set (step S98).

When the phrase mode is not set, program control branches to step S99, and the sequential steps of the above-described tone-ON process are performed.

When the phrase mode has been selected, a phrase playing start process is performed (step S102). Through this process, an automatic playing flag is set, and the head address of the phrase play data stored in the play data memory 16 is set in the phrase play section 17.

Then, a process for outputting phrase data is performed (step S103). Through this process an external device is informed that the setting of the automatic playing flag is ON, i.e., that phase playing should be started. More specifically, a phrase number is output that designates the phrase play data (identified by a phrase number) that correspond to the key number.

The counter is then incremented (step S104), and a check is made to determine whether the iteration count held by the counter is less than "12", i.e., to determine whether a process for one octave has been completed (step S105). If the iteration count held by the counter is less than "12", the procedure returns to step S96 and the above-described processing is repeated. When the iteration count held by the counter has become "12", or greater, through this process iteration, program control returns from the key process routine.

To simplify the explanation, the above-described key process is presented for only one octave; however, this key process will be performed for as many octaves as are required by the key count of the keyboard 10.

Figure 8:
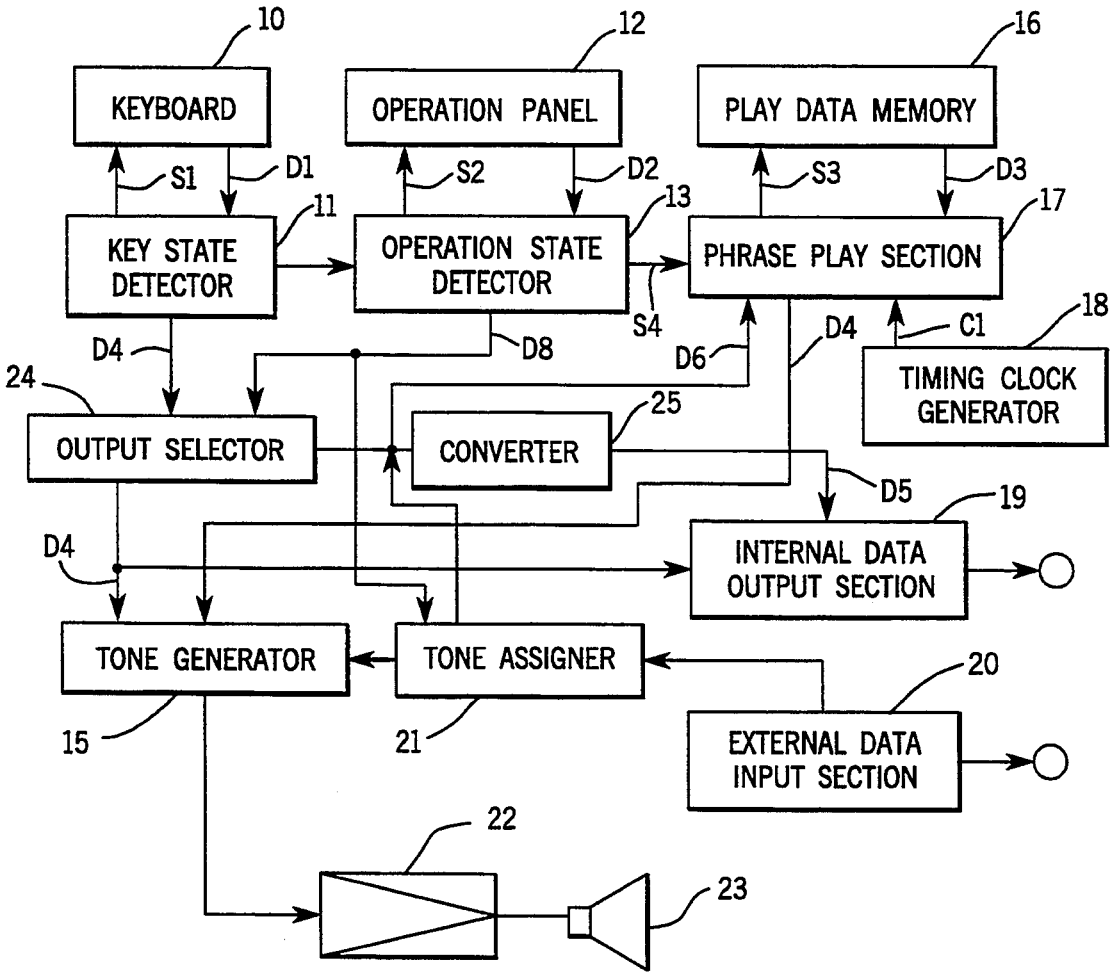
FIG. 8 is a schematic block diagram illustrating the general arrangement of the second embodiment of a phrase data input/output apparatus according to the present invention.

FIG. 8, a block diagram, shows the structure of the second embodiment of the present invention. The structure of the second embodiment differs from that of the first embodiment (shown in FIG. 1). Instead of the tone assigner 14, the second embodiment has an output selector 24 that sends its output to the internal data output section 19 via a converter 25.

The converter 25 converts the data from the output selector 24 into data D5 for instructing a phrase pattern and a playing start. The data D5 is therefore not sent from the phrase play section 17 in FIG. 1.

Since the other components and their functions are the same as those in the block diagram in FIG. 1, explanations for them are not included here.

As described above, according to the present invention, it is possible to provide a phrase data input/output apparatus that sends to an external device data for instructing phrase playing, but does not send thereto key data which is used for phrase playing; and that reduces the load placed on the output processing means.

What is claimed is:

1. A phrase data input/output apparatus for an electronic musical instrument having an external device connectable thereto, said apparatus, upon receipt of key data from a keyboard, either selecting tone generating means for generating a single musical tone in agreement with the key data in normal playing of the instrument or selecting phrase playing means for generating a specified phrase of multiple musical tones in agreement with the key data in phrase playing of the instrument, thereby to produce music, said apparatus comprising:

instructing means (13) for instructing either normal playing or phrase playing of the instrument;

assigning means (14) assigning the key data from the keyboard to either the tone generating means (15) or to the phrase playing means (17) of the instrument, upon receipt of an instruction from said instructing means; and output means (19) for connecting the electronic musical instrument to the external device, said output means being coupled to said tone generating means and to said phrase playing means and being responsive to said assigning means for sending to the external device either key data, outputted by the tone generating means, or phrase playing control data specifying a phrase pattern and outputted by the phrase playing means, said phrase playing control data being obtained through a predetermined conversion of said key data from said keyboard.

2. An apparatus according to claim 1 further comprising input means (20) for connecting the electronic musical instrument to the external device for receiving data therefrom, and said apparatus comprising further assigning means (21) coupled to said input means for assigning data sent from the external device to either said tone generating means or said phrase playing means.

3. An apparatus according to claim 1 wherein said output means is further defined as means for sending only phrase playing control data to the external device when phrase playing is performed by the musical instrument.

4. A phrase data input/output apparatus for an electronic musical instrument having an external device connectable thereto, said apparatus, upon receipt of key data from a keyboard, either selecting tone generating means for generating a single musical tone in agreement with the key data in normal playing of the instrument or selecting phrase playing means for generating a specified phrase of multiple musical tones in agreement with the key data in phrase playing of the instrument, thereby to produce music, said apparatus comprising:

instructing means (13) for instructing either normal playing or phrase playing of the instrument;

output selecting means (24) for selecting either said tone generating means or said phrase playing means to receive key data from said keyboard upon receipt of an instruction from said instructing means;

converting means (25) for converting the key data into phrase playing control data specifying a phrase pattern when said phrase playing means is selected by said output selecting means; and output means (19) for connecting the electronic musical instrument to the external device, said output means being coupled to said converting means for sending to the external device either key data outputted by said output selecting means, or said phrase playing control data outputted by said converting means in consonance with the selection by said output selecting means.

5. An apparatus according to claim 4 further comprising input means (20) for connecting the electronic musical instrument to the external device for receiving data therefrom, and said apparatus comprising assigning means (21) coupled to said input means for assigning data sent from the external device to either said tone generating means or said phrase playing means and said converting means.

6. An apparatus according to claim 4 wherein said output means is further defined as means for sending only phrase playing control data to the external device when phrase playing is performed by the musical instrument.

* * * * *